US006203395B1

(12) United States Patent
McElhaney

(10) Patent No.: US 6,203,395 B1
(45) Date of Patent: Mar. 20, 2001

(54) ELECTRONIC ACTIVITY CENTER

(75) Inventor: Craig J. McElhaney, Cumberland, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 09/332,963

(22) Filed: Jun. 14, 1999

(51) Int. Cl.[7] ..... A63H 33/00
(52) U.S. Cl. ..... 446/227; 446/175
(58) Field of Search ..... 446/7, 29, 175, 446/227, 71

(56) References Cited

U.S. PATENT DOCUMENTS

| | | | | |
|---|---|---|---|---|
| D. 339,173 | | 9/1993 | Marschak . | |
| 2,437,241 | | 3/1948 | Burlin . | |
| 2,461,682 | | 2/1949 | DeFerrari . | |
| 3,548,518 | * | 12/1970 | McRae | 35/12 |
| 3,936,955 | * | 2/1976 | Gruen et al. | 35/11 |
| 4,221,072 | * | 9/1980 | Monin | 446/7 |
| 4,502,680 | * | 3/1985 | Blum . | |
| 4,627,588 | | 12/1986 | Block . | |
| 4,702,719 | * | 10/1987 | Lapid | 446/227 |
| 4,767,334 | * | 8/1988 | Thorne et al. | 434/29 |
| 4,973,286 | * | 11/1990 | Davison | 446/175 |
| 5,015,189 | * | 5/1991 | Wenzinger, Jr. | 434/63 |
| 5,076,520 | | 12/1991 | Bro . | |
| 5,107,743 | * | 4/1992 | Decker . | |
| 5,260,869 | * | 11/1993 | Ferrier et al. | 364/413.01 |
| 5,314,372 | * | 5/1994 | Kramer | 446/404 |
| 5,454,745 | | 10/1995 | Spielberger . | |
| 5,478,268 | * | 12/1995 | Au | 446/227 |
| 5,571,999 | * | 11/1996 | Harris . | |
| 5,584,531 | | 12/1996 | Bowman . | |
| 5,788,253 | * | 8/1998 | Thomson et al. | 446/71 |
| 6,053,878 | * | 4/2000 | Fell et al. | 600/595 |

OTHER PUBLICATIONS

Fisher Price Corp., "Kick & Play Piano", 2 pages, Faxed by Applicant May 9, 2000, Sometime before Jun. 14, 1999.*

* cited by examiner

*Primary Examiner*—Jacob K. Ackun
*Assistant Examiner*—F. Francis
(74) *Attorney, Agent, or Firm*—Barlow, Josephs & Holmes, Ltd.

(57) ABSTRACT

An electronic activity center for infants includes a spring biased kick bar, a cross bar supported above the infant, a plurality of hanging toys suspended from the cross bar, and a rotating "motion" bar with rotating flippers and disks mounted on the cross bar. The kick bar and the hanging toys are connected to an electronic control unit mounted inside the frame of the activity center. The electronic control unit controls output of music and sounds responsive to movement of the kick bar and/or hanging toy. The electronic unit also controls motion the rotating bar responsive to movements of the kick bar and hanging toys. Activation of the music, sounds and rotating bar responsive to movement of the kick bar and/or hanging toys are believed to encourage kicking of the infant's feet and swinging of the infant's arms and thus aid in the development of motor skills.

6 Claims, 12 Drawing Sheets

ELECTRONIC ACTIVITY CENTER

BACKGROUND AND SUMMARY OF THE INVENTION

The instant invention relates to electronic toys for infants and more particularly to an electronic activity center comprising a spring biased kick bar at ground level, and an overhead cross bar having a plurality of hanging toys suspended above the infant. An electronic unit mounted inside the activity center controls output of music and sounds responsive to movement of the kick bar and/or the hanging toys. The electronic unit also controls motion of a rotating bar on the cross bar responsive to movements of the kick bar and hanging toys. Activation of the music, sounds and rotating bar responsive to movement of the kick bar and/or hanging toys are believed to encourage kicking of the infant's feet and swinging of the infant's arms and to thus aid in the development of motor skills.

At just a few months of age, infants begin actively kicking their feet and swinging their arms as a means of showing excitement and emotion, and also as a means of exploring their immediate surroundings. In this regard, a variety of different types of toys have been developed to encourage infants to use these natural kicking and swinging movements. Prior art toys of this type include play gyms having overhead suspended toys and further include spring mounted kick plates. For example, the Thomson et al U.S. Pat. No. 5,788,253, Bro U.S. Pat. No. 5,076,520 and Block U.S. Pat. No. 4,627,588 each discloses a baby gym having toys suspended from an overhead bar. An infant positioned on its back beneath the bar is able to both kick and swing at the suspended toys thereby aiding in the development of manual dexterity and hand eye coordination.

The Ferrari U.S. Pat. No. 2,461,682 discloses a crib exercise device comprising a flat board which is mounted to the legs of a crib by elastic members. The board is suspended in a vertical orientation in the crib by the elastic members and is presented for kicking by an infant in the crib. When the infant kicks or hits the board, the board springs up and down and back and forth in an amusing manner.

An electronic piano device is also known in the prior art. The device can be mounted in a vertical orientation and used as a kick board for infants. When the infants feet engage buttons on the piano, sounds or tones associated with the respective buttons are output.

The Davison U.S. Pat. No. 4,973,286 discloses another type of crib toy which includes noise devices that can be kicked or hit by an infant in the crib. The noise devices include a rattle, a bell, and a squeaker. When these devices are hit or kicked by the infant's hands or feet, they make an audible noise which in turn activates a sound responsive musical circuit. The musical control circuit also activates a motor which spins and moves cartoon figures mounted in the housing.

The Au U.S. Pat. No. 5,478,268 discloses an electronic activity gym having a frame, an overhead cross bar, and a plurality of hang toys suspended from the cross bar. The hanging toys are suspended from the cross bar by a pivot assembly mounted within the cross bar. When an infant positioned below the cross bar hits, kicks or otherwise touches the hanging toys, the pivot assembly pivots and closed a switch that activates an electronic music and sound system.

The instant invention provides an improved electronic activity center for an infant comprising a frame, a spring biased kick bar pivotably mounted to the frame, a cross bar supported above the infant, a plurality of hanging toys suspended from the cross bar, and a rotating "motion" bar with rotating flippers and disks mounted on the cross bar. The kick bar and the hanging toys are connected to an electronic control unit mounted inside the frame of the activity center. The electronic control unit controls output of music and sounds responsive to movement of the kick bar and/or hanging toy. The electronic unit also controls motion the rotating bar responsive to movements of the kick bar and hanging toys. Activation of the music, sounds and rotating bar responsive to movement of the kick bar and/or hanging toys are believed to encourage kicking of the infant's feet and swinging of the infant's arms and thus aid in the development of motor skills.

More specifically, the activity center comprises a cross bar, and a frame having a base portion and spaced upright support members extending upwardly from the base portion. The cross bar is mounted between the spaced upright support members for supporting the cross bar above a supporting surface. A plurality of toy articles are suspended from the cross bar so as to be generally positioned above an infant lying on its back between the upright support members. The hanging toy articles are pivotably movable from an a normal rest position to an active position responsive to engagement by an operator, i.e. swinging of the infants arms or kicking of the infants feet. A first switch is mounted in operable association with the hanging toy articles wherein the first switch is actuable responsive to pivoting movement of the toy articles. The switch is generally movable between a first position corresponding to the at rest position of the toy article and a second position corresponding to the active position of the toy articles.

The electronic activity center further comprises a spring biased kick bar pivotably mounted to the base portion of the frame between the spaced upright support members. The kick bar is pivotably movable between an at rest position and an active position responsive to engagement of the user, i.e. kicking of the infant feet. A second switch is mounted in operable association with the kick bar wherein the second switch is actuable responsive to pivoting movement of the kick bar between a first position corresponding to the at rest position of the kick bar and a second position corresponding to the active position of the kick bar.

The electronic activity center still further comprises a rotating "motion" bar rotatably mounted within the cross bar. The motion bar includes a plurality of disks, flippers etc which rotate with the bar during operation. The rotating bar is driven by a motor and a transmission assembly coupled between the bar and the motor for translating rotation of the motor into a corresponding rotation of the bar.

Finally, the activity center includes a processor device including a sound generating device connected to the first and second switches. In use, the sound generating device initiates output of a sound, such as music, or other sounds, responsive to a respective movement of the hanging toy elements or the kick bar, i.e. closure of the switches associated therewith. The motor is also controlled by the processor wherein the motor is selectively energized responsive to movements of the hanging toy elements and the kick bar. The processor is operative in several different modes which allow the processor to output sounds and music, or sounds and music and movement of the motion bar.

Accordingly, among the objects of the instant invention are: the provision of an electronic activity center for an infant which encourages natural kicking and arm swinging movement; the provision of an electronic activity center for an infant including a sound generation device which outputs sounds and music responsive to kicking of a spring biased kick bar; the provision of an electronic activity center for an infant including a sound generation device which outputs sounds and/or music responsive to hitting of hanging toys suspended from an overhead cross bar; and the provision of such an activity center further including a movable element which moves responsive to kicking of the kick bar and/or hitting of the hanging toys.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
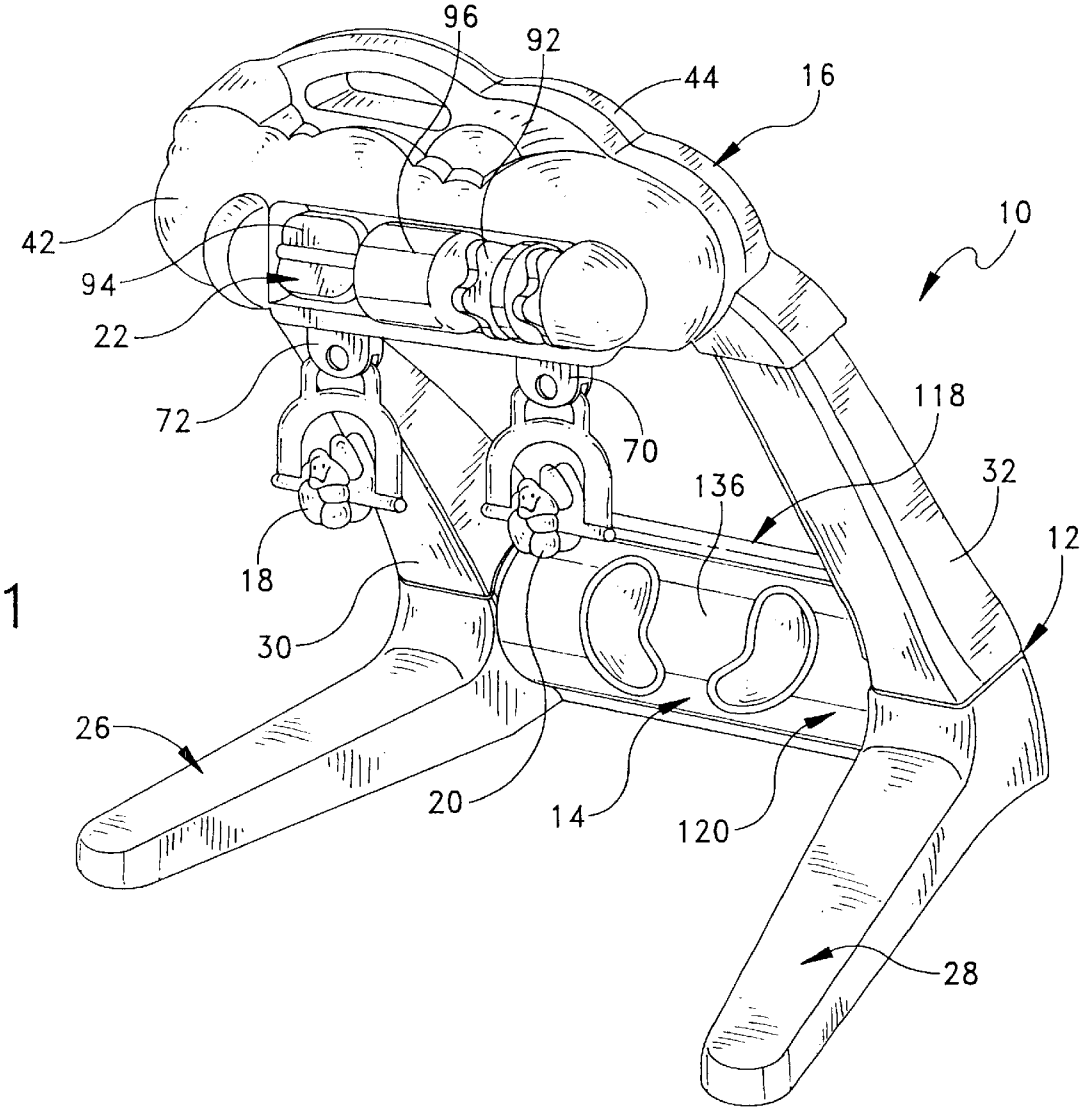
FIG. 1 is a perspective view of the electronic activity center of the present invention.
Figure 1A:
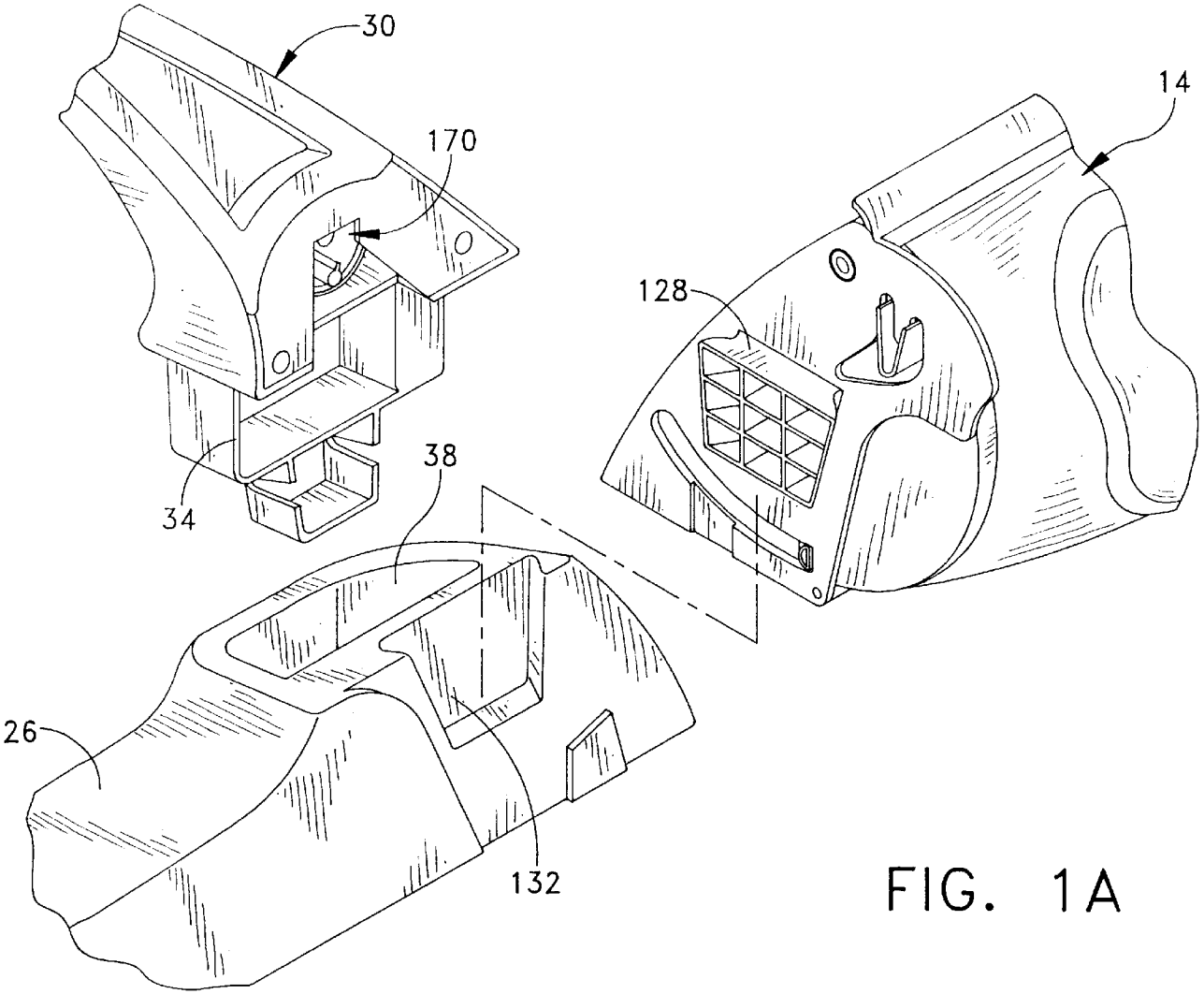
FIG. 1A is an exploded assembly view thereof.
Figure 1B:
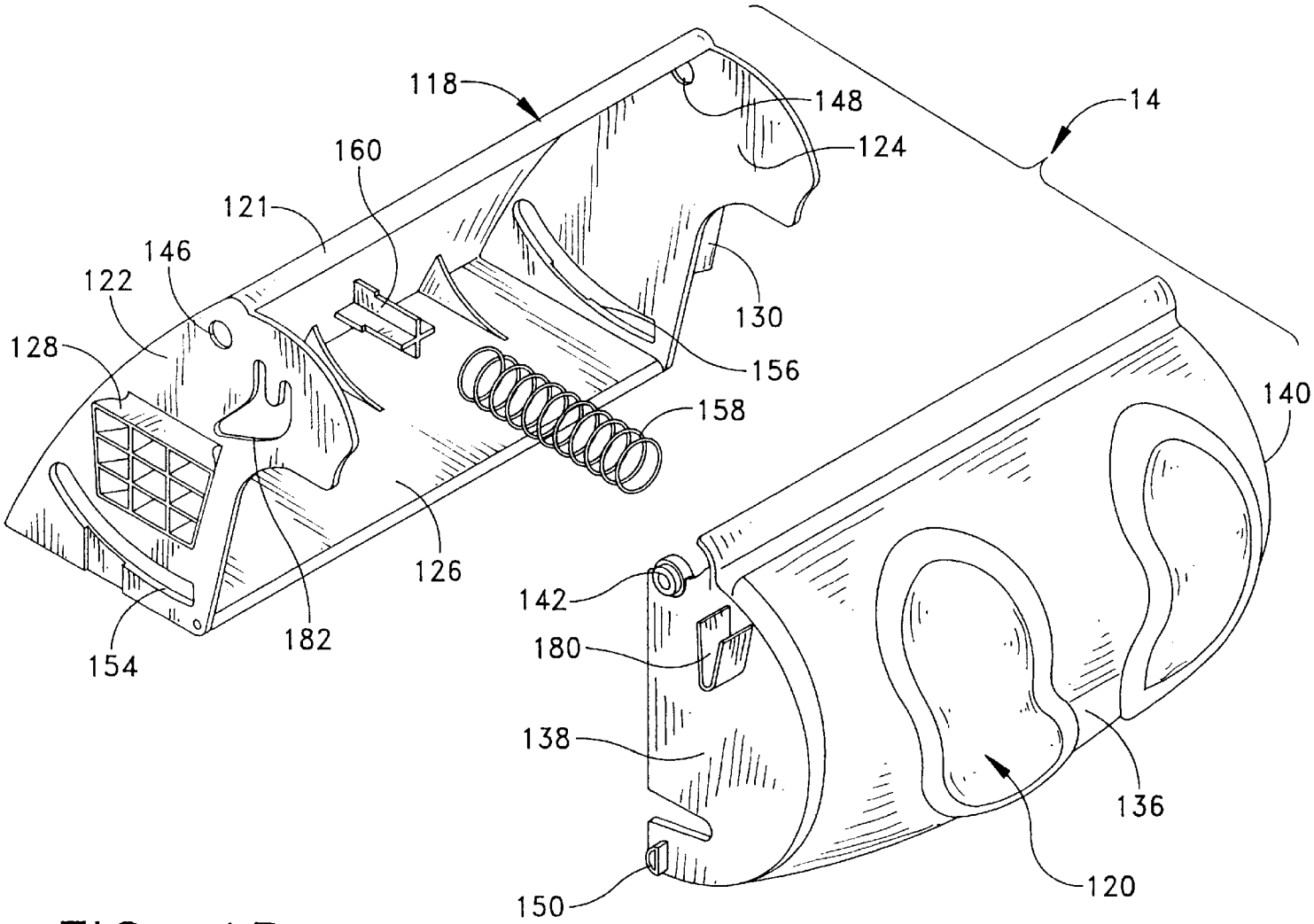
FIG. 1B is an exploded assembly view of the kick bar assembly.
Figure 2:
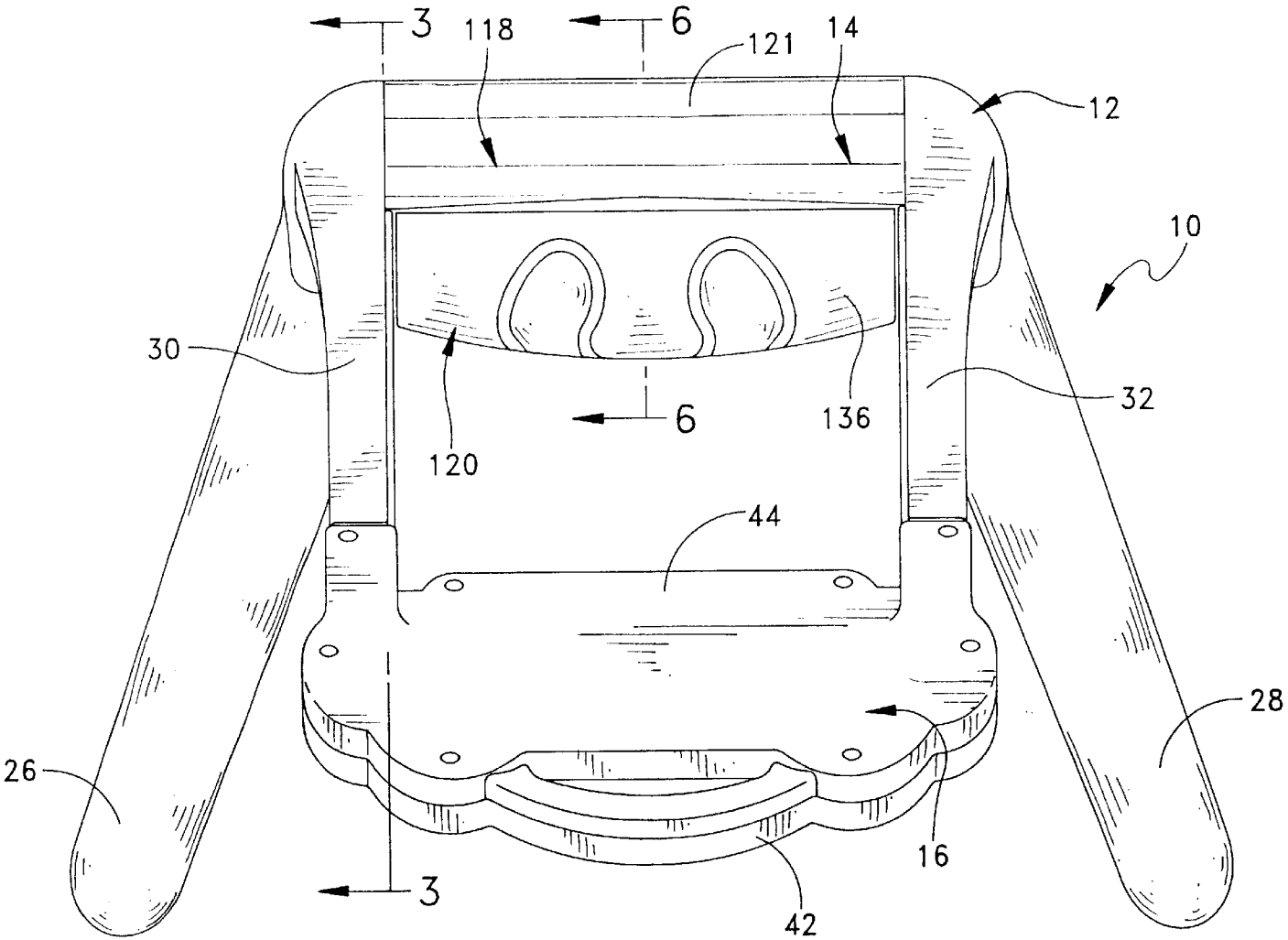
FIG. 2 is a top view thereof.
Figure 3:
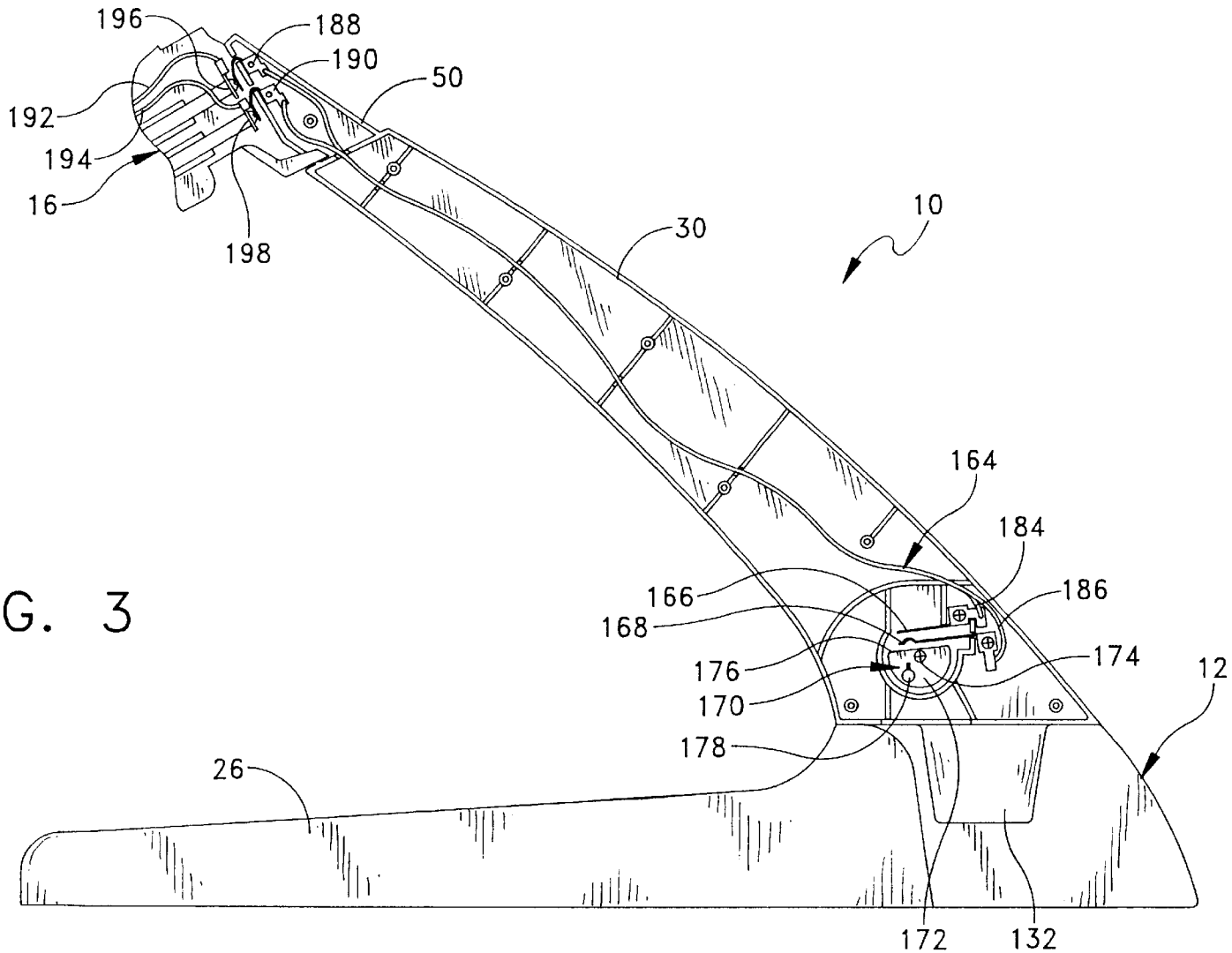
FIG. 3 is a cross-sectional view of the upright support as taken along line 3—3 of FIG. 2.
Figure 4:
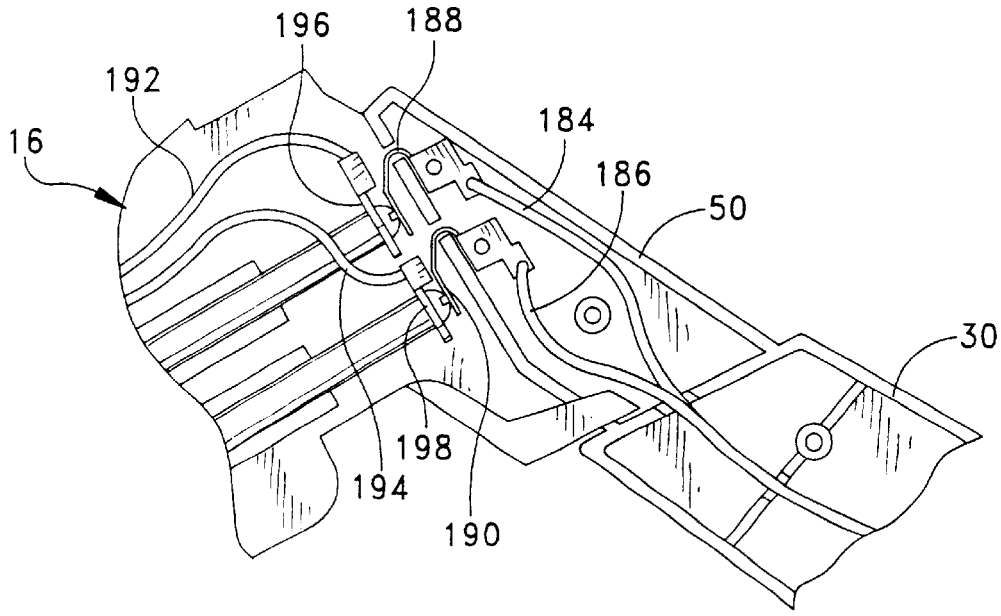
FIG. 4 is an enlarged fragmentary cross-sectional view of the kick bar contact plates.
Figure 5:
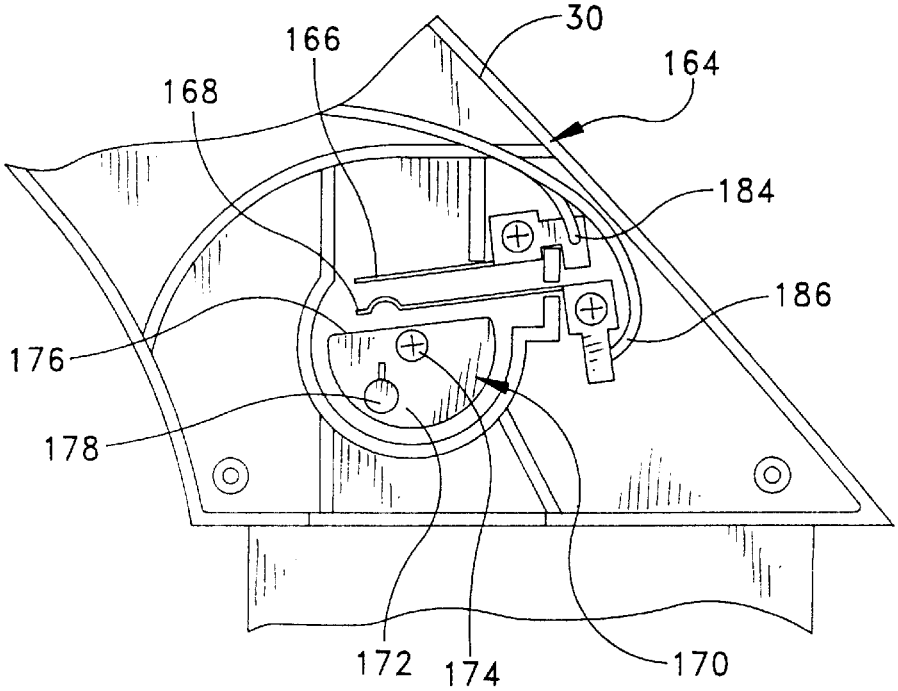
FIG. 5 is an enlarged fragmentary cross-sectional view of a secondary contact assembly.
Figure 6:
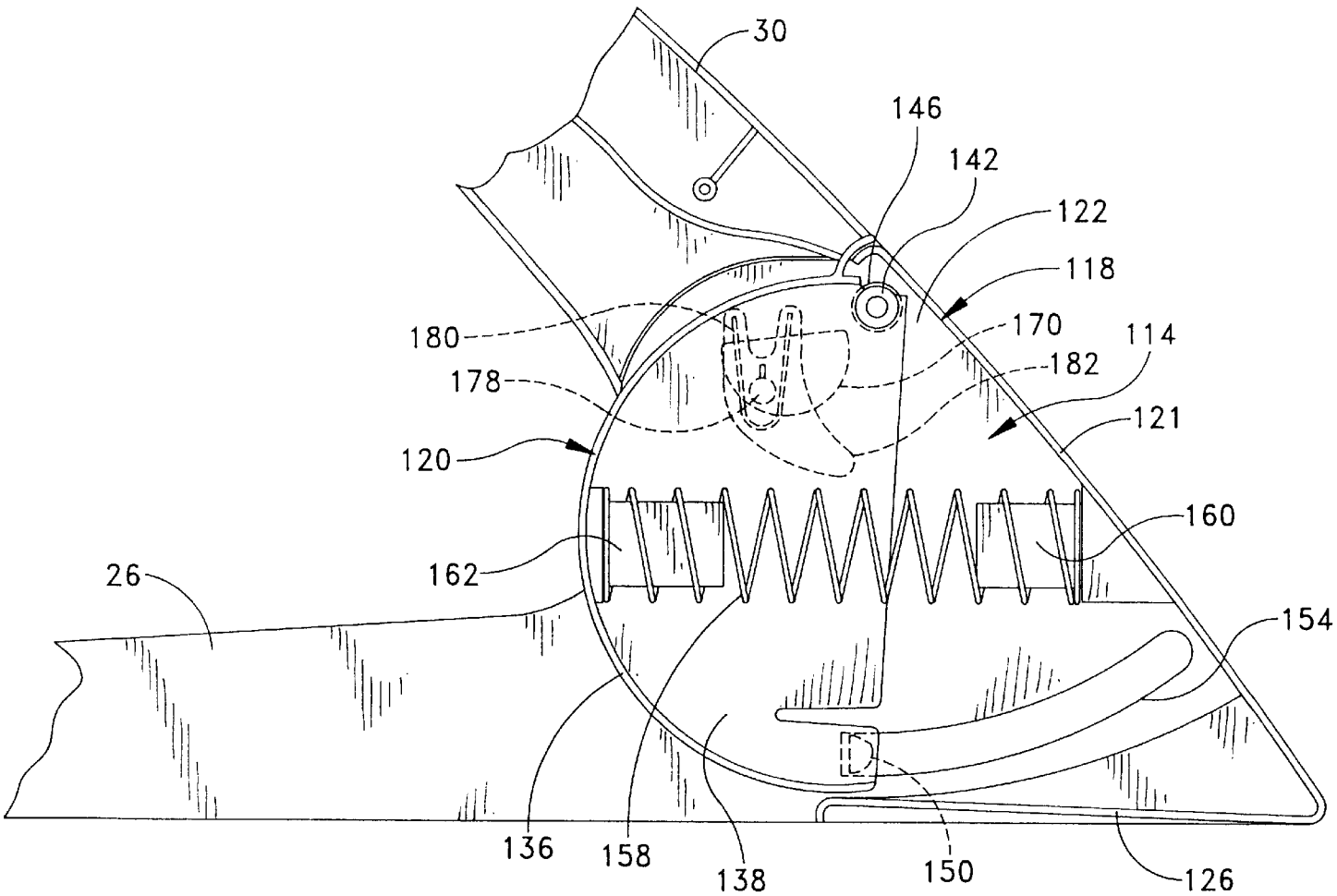
FIG. 6 is a cross-sectional view of the kick bar as taken along line 6—6 of FIG. 2.

Referring now to the drawings, the electronic activity center of the instant invention is illustrated and generally indicated at 10 in FIGS. 1–13. As will hereinafter be more fully described, the instant electronic activity center 10 provides an improved toy having enhanced play and developmental value.

Unless otherwise indicated herein, it is to be understood that the component parts of the present device are preferably molded from a polymer material which is sufficiently durable and safe for use with infants and children of toddler age.

The electronic activity center 10 comprises a frame generally indicated at 12, a spring biased kick bar assembly generally indicated at 14, a cross bar assembly generally indicated at 16, a pair of hanging toys 18, 20 suspended from the cross bar 16, and a rotating motion bar generally indicated at 22 disks mounted on the cross bar 16. The kick bar 14 and the hanging toys 18, 20 are associated with an electronic control unit generally indicated at 24 in FIG. 13. The electronic control unit 24 is mounted inside the frame 12 of the activity center 10 wherein the electronic control unit 24 controls output of music and sounds responsive to movement of the kick bar 14 and/or hanging toys 18, 20. The electronic unit 24 also controls motion the rotating bar 22 responsive to movements of the kick bar 14 and hanging toys 18, 20. Activation of the music, sounds and rotating bar 22 responsive to movement of the kick bar 14 and/or hanging toys 18, 20 are believed to encourage kicking of the infant's feet and swinging of the infant's arms and thus aid in the development of motor skills.

The frame 12 comprises first and second spaced leg members 26, 28 respectively, which form a base, and first and second spaced upright support members 30, 32 respectively extending upwardly from the leg members 26, 28. In this regard, the bottom ends of the upright support members 30, 32 include narrower post portions 34 (only one shown) which are inserted into corresponding recesses 38 (only one shown) in the leg members 26, 28. The legs 26, 28 and the upright support members 30, 32 have a hollow interior and can be formed in either a one piece or two piece construction depending on molding techniques and the need to provide space for interior wiring of the electronic control unit 24.

The cross bar 16 is mounted between the upper ends of the spaced upright support members 30, 32 for supporting the cross bar 16 above a supporting surface. The cross bar 16 comprises front and rear sectional halves 42, 44 which are received and secured together in interfitting relation by a plurality of fasteners (not shown). The front and rear sectional halves cooperate to form two sockets 46, 48 for receiving narrow post portions 50 (only one shown) at upper ends of the upright support members 30, 32.

The pair of hanging toys 18, 20 are suspended from the cross bar 16 so as to be generally positioned above an infant lying on its back between the upright support members 30, 32. The hanging toys 18, 20 can comprise any design or object which is suitable for the application. More specifically, the hanging toys 18, 20 are releasably mounted to a clip bar generally indicated at 54 (See FIG. 9 for best illustration). The clip bar 54 is pivotably captured within the cross bar 16 and includes a central rod portion 56 which is seated in two spaced seats 58, 60 formed in the front sectional half 42 of the cross bar 16. The clip bar 54 further includes two spaced arm portions 62, 64 which extend outwardly from the central rod 56, through two spaced openings 66, 68 formed in the lower mating edge of the front and rear sectional halves 42, 44. At the terminal ends of the spaced arm portions 66, 68 are clips 70, 72 into which the hanging toys 18, 20 are releasably clipped. Extending in an opposite direction from the arm portions 62, 64 is an actuator leg 74. The terminal end 76 of the actuator leg 74 is positioned for engagement with a first switch assembly 78 comprising two spaced contact arms 80, 82. The hanging toys 18, 20, i.e. the clip bar 54 are pivotably movable from a normal rest position (FIG. 11) to an active position (FIG. 12) responsive to engagement by an operator, i.e. swinging of the infants arms or kicking of the infants feet. In this regard, the first switch assembly 78 is actuable responsive to pivoting movement of the toy articles 18, 20. The switch 78 is generally movable between a first, open circuit, position (FIG. 11) corresponding to the at rest position of the toy articles 18, 20 and a second, closed circuit, position (FIG. 12) corresponding to the active position of the hanging toys 18, 20. The contact arms 80, 82 are connected to the electronic unit 24 by wires 84, 86 wherein the input is used to control output of the electronic unit 24. Although a conventional biased contact switch assembly 78 is illustrated and described herein, it is to be understood that other types of switches, such as motion switches, tilt switches, membrane switches, impact switches etc. are also suitable for use in the context of the present invention.

The rotating "motion" bar 22 comprises a shaft 88 which is rotatably captured in a housing 90 attached to the front sectional half 42 of the cross bar 16, and further includes a plurality of disks 92, flippers 94, and wheels 96, etc which are keyed to the shaft 88 so as to rotate with the shaft 88 during operation. The shaft 88 is driven by a electronic motor 98 and a transmission assembly generally indicated at 100 coupled between the shaft 88 and the drive shaft 102 of the motor 98 for translating rotation of the drive shaft 102 of the motor 98 into a corresponding rotation of the shaft 88. The transmission assembly 100 comprises a first pulley 104 on the drive shaft 102 of the motor 98 and a second pulley 106 mounted on a secondary gear shaft 108. A belt 110 connects the pulleys 104, 106 together. The pulley 106 includes a drive gear 112 that intermeshes with a reduction gear 114 keyed to the shaft 88 of the motion bar 22. In this regard, rotation of the drive shaft 102 of the motor 98 causes a corresponding rotation of the shaft 88 of the motion bar 22. The motor 98 is energized through wires 116 that are connected to the electronic control circuit 24. The cross bar 16, hanging toys 18 and 20, motion bar 22, disks 92, flippers, 94, wheels 96 all cooperate to provide an "activity bar or panel" for the amusement of the infant.

The spring biased kick bar assembly 14 is mounted between the spaced leg members 26, 28 and the spaced upright support members 30, 32. The kick bar assembly 14 comprises a housing portion 118 and a kick plate portion 120 that is pivotably mounted to the housing portion 118. The housing portion 118 comprises a rear wall 121, side walls 122, 124 respectively extending forwardly from the rear wall 120, and a bottom wall 126. The housing portion 118 further includes a pair of opposing vertically oriented dovetail wedges 128, 130 which are received in complementary dovetail slots 132, 134 formed in the inner side surfaces of the spaced leg members 26, 28. In this regard, the housing 118 is captured and maintained in assembled relation with the leg members 26, 28 by the upright support members which are inserted into the recesses 38, 40 in the leg members after assembly of the dovetail wedges 128, 130 of the kick bar assembly 14. The kick plate 120 comprises an arcuate front wall 136, and opposing side walls 138, 140 extending rearwardly from the front wall 136. The kick plate 120 is pivotably mounted to the housing 118 by opposing pivot pins 142 (only one shown) which extend outwardly from the side walls 138, 140 of the kick plate 120 and engage with corresponding openings 146, 148 formed in the side walls 122, 124 of the housing 118. Pivot of the kick plate 120 about the pivot pins 142, 144 is guided by a pair of posts 150 (only one shown) that extend outwardly from the side walls 138, 140 of the kick plate 120 and ride within curved slots 154, 156 formed in the side walls 122, 124 of the housing 118. The kick plate 120 is pivotably movable between a normal at rest position (FIG. 6) and an active, or depressed, position (FIG. 7) responsive to engagement of the user, i.e. kicking of the infant feet. The kick plate 120 is normally biased outwardly to the at rest position (FIG. 6) by a biasing element, i.e. coil spring 158, that is captured between a post 160 on the rear wall 121 of the housing 118 and a post 162 on the front wall 136 of the kick plate 120.

Figure 7:
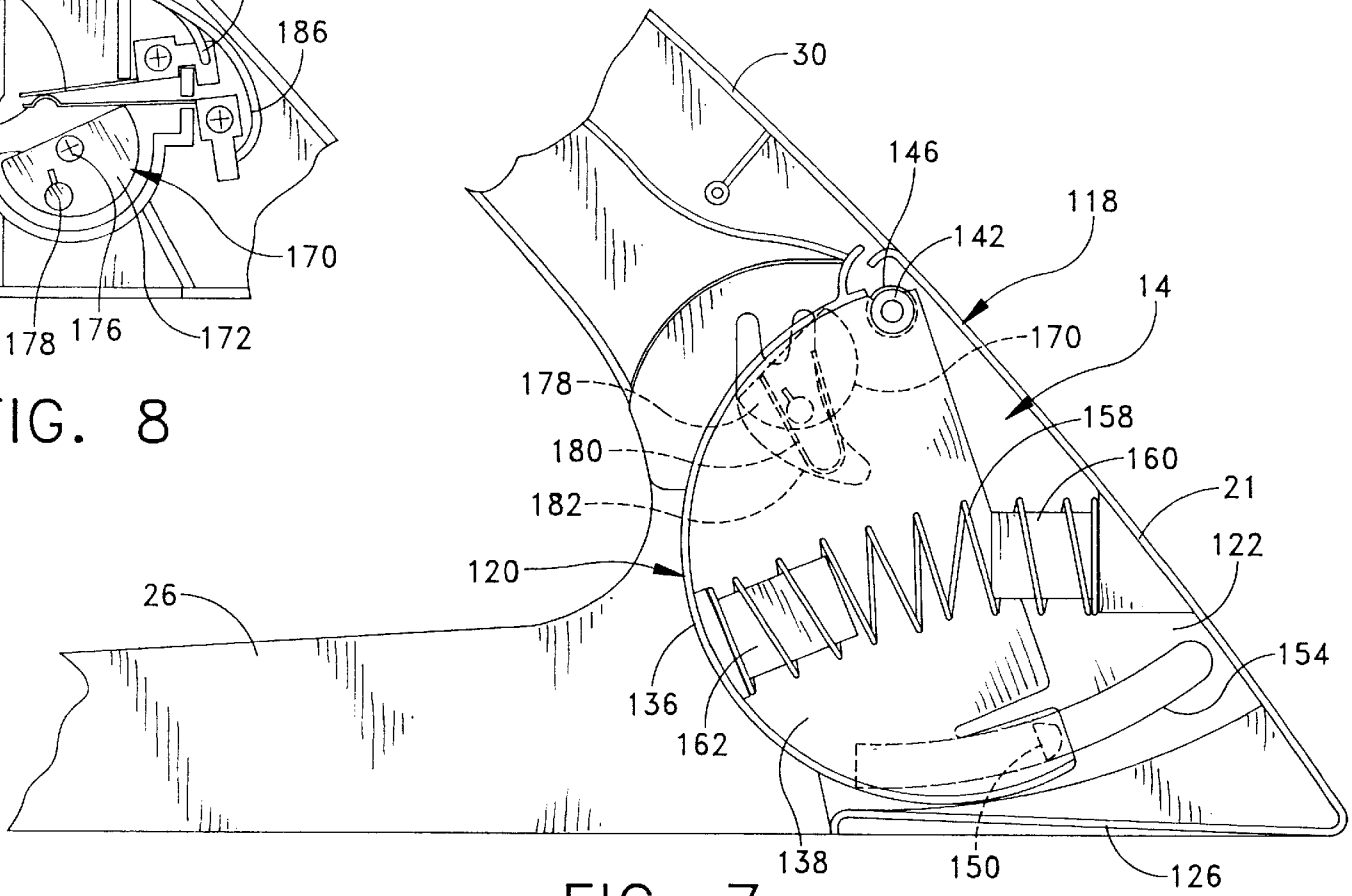
FIG. 7 is another cross-sectional view thereof showing rotational movement of the kick bar.
Figure 8:
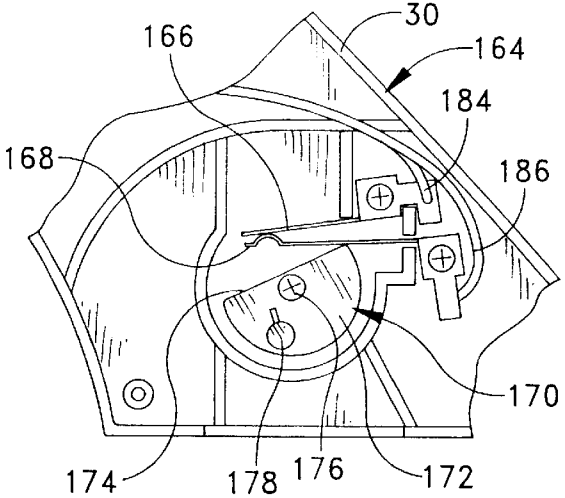
FIG. 8 is another enlarged fragmentary cross-sectional view showing engagement of the kick bar contact plates when the kick bar is rotated as shown in FIG. 7.
Figure 9:
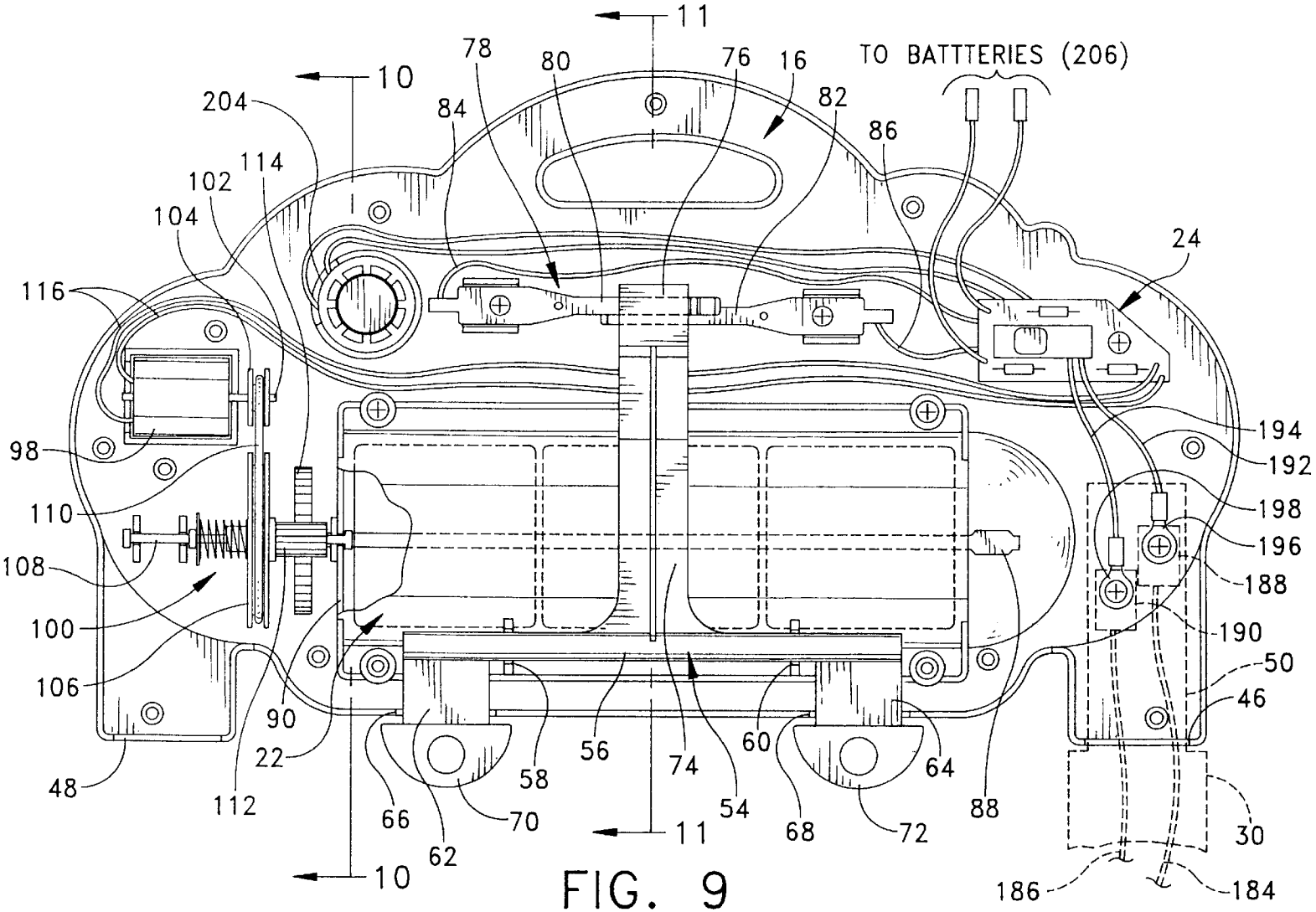
FIG. 9 is an elevational view of the cross bar with the back cover removed.
Figure 10:
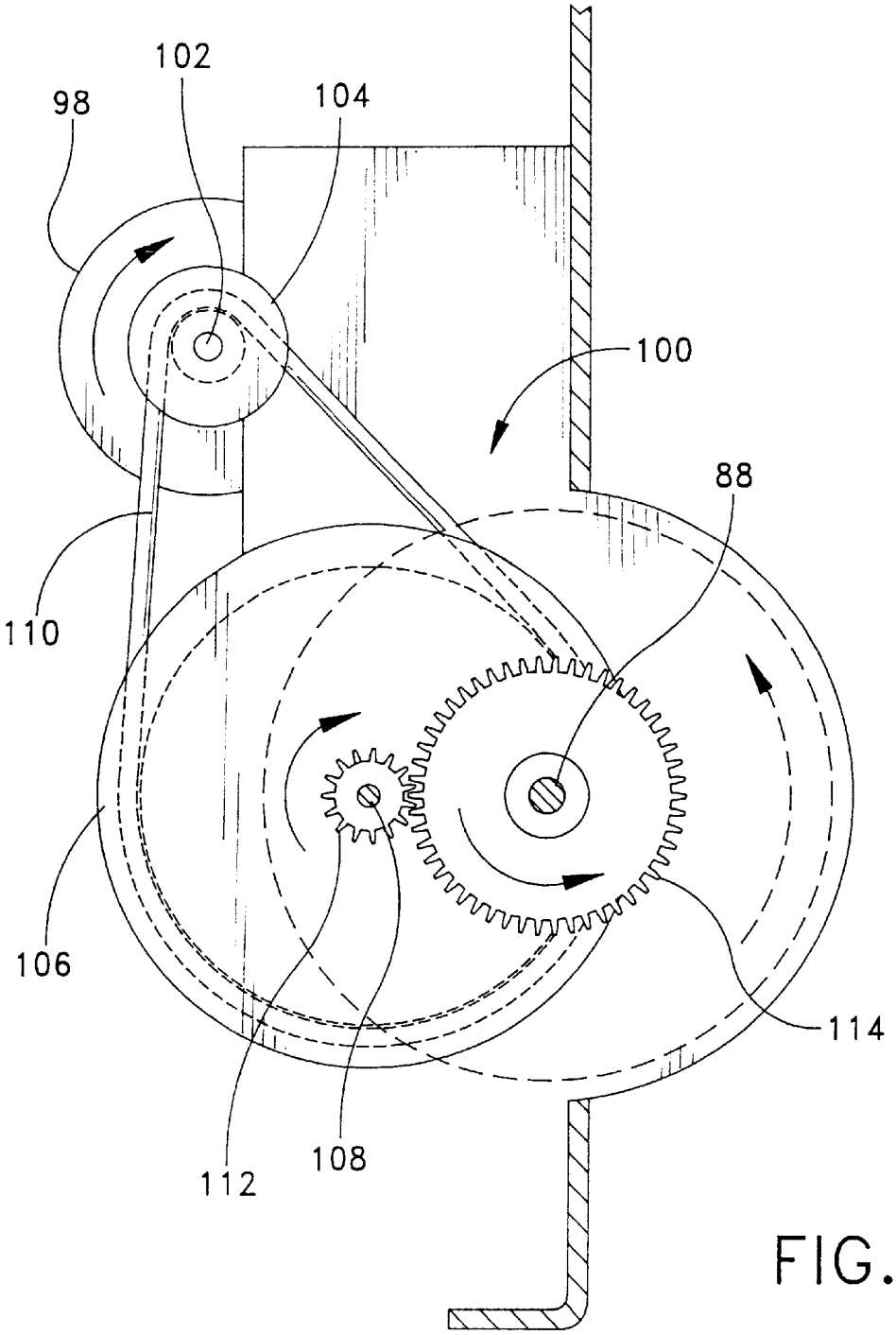
FIG. 10 is a cross-sectional view of the cross bar as taken along line 10—10 of FIG. 9 showing the gear assembly for the rotating activity bar.
Figure 12:
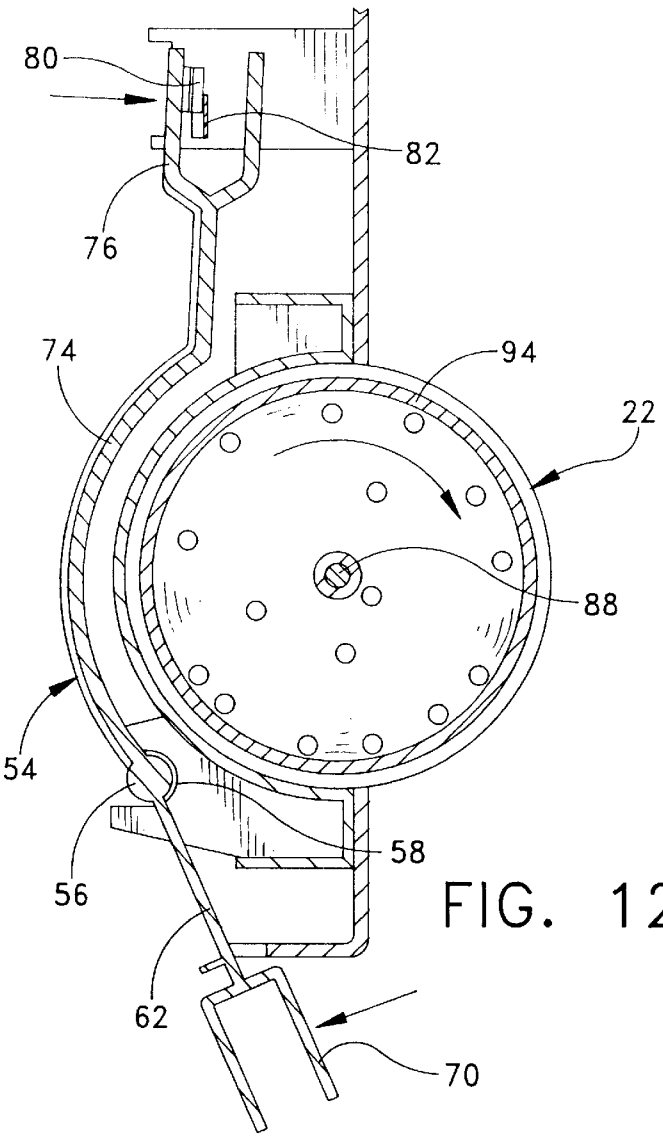
FIG. 12 is yet another cross-sectional view of the cross bar showing engagement of the hanging toy contact plates.
Figure 11:
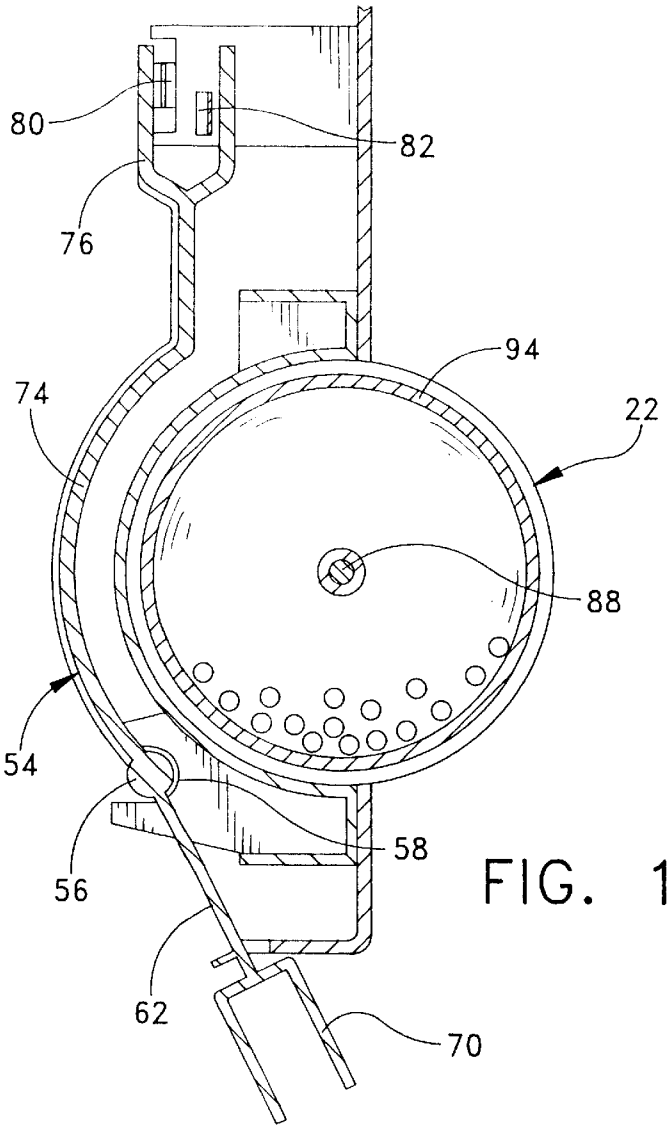
FIG. 11 is another cross-sectional view of the cross bar as taken along line 11—11 of FIG. 9 showing a normal rest position of the hanging toy contact plates.
Figure 13:
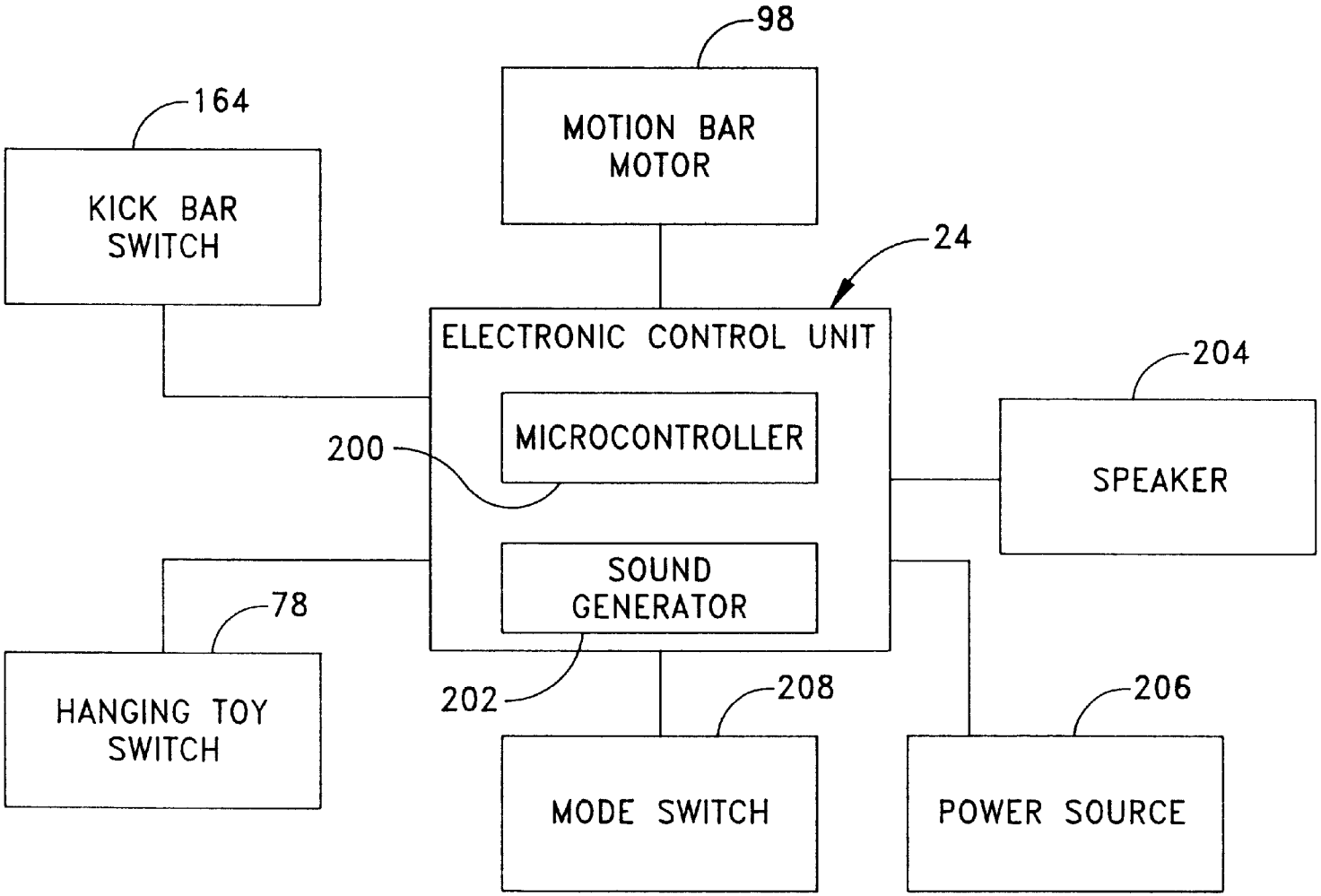
FIG. 13 is a schematic block diagram of the electronic unit of the toy.

A second switch assembly 164 is mounted in operable association with the kick bar assembly 14 wherein the second switch assembly 164 is actuable responsive to movement of the kick plate 120. Once again, although a conventional biased contact switch assembly 164 is illustrated and described herein, it is to be understood that other types of switches, such as motion switches, tilt switches, membrane switches, impact switches etc. are also suitable for use in the context of the present invention. The switch assembly 164 is mounted within the upright support member 30 and comprises first and second contact arms 166, 168 mounted in spaced relation. Mounted in operable association with the contact arms 166, 168 is a pivoting cam generally indicated at 170 operable for closure of the switch assembly 164 during use. The cam 170 comprises a cam body 172 pivotably mounted to the upright support member 30 on a post 174. The cam body 172 includes a flat cam surface 176 which engages the second contact arm 168 for closure of the switch 164. The cam 170 further includes an actuator post 178 which extends perpendicularly outwardly from the cam body 170. The actuator post 178 is received within channel walls 180 which extends perpendicularly outwardly from the side wall 138 of the kick plate 120. The channel walls 180 extend through a slot 182 in the side wall 122 of the housing 118. When the upright support member 30 is assembled with the leg member 26 the actuator post 178 is seated within the channel walls 180. In use, when the kick plate 120 is moved from the at rest position (FIGS. 5 and 6) to the depressed position (FIGS. 7 and 8), the channel walls 180 engage the actuator post 178 and rotate the cam body 170. The cam surface 176 in turn moves upwardly into engagement with the cantilevered contact arm 168 and temporarily closes the switch 164. In this regard, the switch 164 is generally movable between a first, open circuit, position (FIG. 5) corresponding to the at rest position of the kick plate (FIG. 6) and a second, closed circuit, position (FIG. 8) corresponding to the depressed position of the kick plate (FIG. 7). The contact arms 166, 168 are connected to the electronic unit 24 in the cross bar 16 by wires 184, 186. The wires 184, 186 extend upwardly through the upright support member 30 where they are terminated at contact plates 188, 190. Final connection to the electronic control unit 24 within the cross bar assembly 16 is accomplished by a second set of wires 192, 194 and contacts 196, 198 mounted within the cross bar assembly 16. More specifically, wires 192, 194 extend from the electronic control unit 24 to the socket 46 that receives the upper post 50 of the upright support member 30. When the cross bar 16 is assembled with the support members 30, 32 the contacts 196, 198 engage contact terminals 188, 190 to complete the circuit.

The electronic control unit 24 includes an integrated microcontroller device 200 and a sound generating device 202, such as a speech generator or tone generator. Microcontroller devices 200 and sound generator devices 202 of the type contemplated herein are well known in the electronics arts, and the use and operation thereof is believed to be well within one skilled in this art. It is noted that such devices are commonly provided as a single integrated unit with all components provided on a single "system on a chip". As indicated previously, the first and second switch assemblies 78, 164 are both connected to the control unit 24, i.e. microcontroller 200 to provide input signals. The motor 98 and sound generator device 202, i.e output devices, are also connected to the microcontroller device 200 and are activated or operated by the microcontroller device 200 responsive to input received from the switch assemblies 78, 164. Sound output from the sound generation device 202 is output to a speaker 204. The entire electronic assembly is powered by batteries 206, or other appropriate power source of appropriate amperage and voltage.

To further control the type of output from the apparatus 10, the assembly includes a two pole mode switch 208 which allows the microcontroller to operate from two different modes of programming instructions. Mode switch 208 is movable between first and second positions corresponding to first and second modes of operation. In a first mode of operation, the electronic control unit 24 outputs a sound and music, responsive to a respective movement of the hanging toys or the kick bar. For example, in a preferred embodiment of the apparatus, the sound generator 202 outputs a fanciful sound, and then plays approximately 10 minutes of music. If the hanging toys 18, 20 or kick bar 14 are actuated again while the music is playing, the sounds and music start again from the beginning. In a second preferred mode of operation, each time the infant bats the hanging toys 18, 20 or kicks the kick bar assembly 14, the electronic control unit 24 outputs a fanciful sound, and the motor 98 is energized for a short period of time to spin the motion bar assembly 22.

In use of the activity center 10, it is noted that the leg members 26, 28 and upright support members 30, 32 are specifically configured and arranged so that an infant may be placed on its back between the leg members 26, 28 with the infant's feet adjacent to the kick bar assembly 14. The kick bar assembly 14 and the hanging toys 18, 20 are positioned at distances which allow an infant to either bat the hanging toys 18, 20 with their hands or kick the hanging toys 18, 20 with their feet, and also to kick or depress the kick bar assembly 14. During play, swinging and kicking of the infants hands and feet will cause engagement and actuation of the hanging toys 18, 20 and/or the kick bar 14, movement of which selectively closes the switches 78, 164 thereby providing input to the microcontroller control device 200. Depending on the mode selected, the electronic control unit will output various sounds and music and activate the spinning motion bar 22.

It can therefore be seen that the present invention provides a novel and effective electronic activity center 10 for an infant which encourages natural kicking and arm swinging movement. The use of multiple input devices 14, 18, 20, which are readily actuable by an infant for generating a response is believed to provide enhanced developmental value for the infant. Furthermore, the use of multiple output schemes is also believed to provide an enhanced play value as well. For these reasons, and others, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An electronic activity center for an infant received on its back on a supporting surface comprising:

a. a frame including a base portion receivable on a supporting surface and an upwardly extending support portion;

b. a kick bar on said base portion of said frame, said kick bar being disposed adjacent said supporting surface when said base portion is received thereon so that said kick bar is engageable by the feet of an infant received on its back on said supporting surface adjacent said base portion;

c. an activity bar on said support portion positioned in upwardly spaced relation to said kick bar when said base portion is received on said supporting surface, said activity bar including at least one movable activity element and being at a level spaced above a torso of said infant when said infant is received on its back on said supporting surface with said kick bar positioned for engagement by the feet of said infant;

d. a switch actuated in response to the application of kicking activity to said kick bar; and e. an electrically powered activity unit on said activity bar actuated in response to activation of said switch, said activity unit including both visible and audible components wherein upon actuation of said switch said visible component producing a visible repetitive change in the appearance of said activity unit and said audible component producing corresponding audible sound.

2. In the electronic activity center of claim 1, said base portion including a pair of spaced supporting leg members, said kick bar extending between said leg members, said leg members extending from said kick bar terminating in free ends, said kick bar and said leg members cooperating to define a receiving area for receiving and positioning said infant in closely straddled relation so that the feet of said infant are immediately adjacent to and engageable with said kick bar.

3. In the activity center of claim 2, said kick bar including a moveable kick plate which faces generally toward said receiving area, said kick plate being moveable relative to said base portion in a direction away from said receiving area for actuating said switch.

4. In the activity center of claim 3, said activity bar facing said receiving area in upwardly space relation to said base.

5. In the activity center of claim 3, said kick plate having a horizontal length sufficient to accommodate two feet of said infant in engagement therewith with said feet positioned in side-by-side relation.

6. In the activity center of claim 1, said activity unit including a motor driven activity element.

* * * * *